US007856928B1

(12) United States Patent
Paulic

(10) Patent No.: US 7,856,928 B1
(45) Date of Patent: Dec. 28, 2010

(54) COUNTERMINE DART SYSTEM AND METHOD

(75) Inventor: Antonio Paulic, Arlington, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 12/151,764

(22) Filed: May 8, 2008

Related U.S. Application Data

(63) Continuation-in-part of application No. 12/150,106, filed on Apr. 23, 2008, now abandoned.

(60) Provisional application No. 60/926,050, filed on Apr. 23, 2007.

(51) Int. Cl.
*F42B 12/16* (2006.01)

(52) U.S. Cl. ..... 102/402; 102/489; 89/1.13

(58) Field of Classification Search ..... 102/401, 102/402, 403, 482, 477, 483, 489, 491, 497; 86/50; 89/1.13, 1.1
See application file for complete search history.

(56) References Cited

U.S. PATENT DOCUMENTS

| | | | | | |
|---|---|---|---|---|---|
| 2,490,389 | A * | 12/1949 | Wales, Jr. | ..... | 102/235 |
| 3,646,888 | A * | 3/1972 | Posson et al. | ..... | 102/496 |
| 3,707,912 | A * | 1/1973 | Duncan et al. | ..... | 102/397 |
| 4,706,569 | A * | 11/1987 | Wallow et al. | ..... | 102/518 |
| 5,792,980 | A * | 8/1998 | Weimann | ..... | 102/476 |
| 6,035,785 | A * | 3/2000 | Sabathier et al. | ..... | 102/476 |
| 6,155,155 | A * | 12/2000 | Moshier | ..... | 89/1.13 |
| 6,202,531 | B1 * | 3/2001 | Comeyne | ..... | 89/1.13 |
| 6,227,095 | B1 * | 5/2001 | Woodall et al. | ..... | 89/1.13 |
| 6,308,607 | B1 * | 10/2001 | Woodall et al. | ..... | 89/1.13 |
| 6,308,634 | B1 * | 10/2001 | Fong | ..... | 102/476 |
| 6,510,797 | B1 * | 1/2003 | Fong | ..... | 102/476 |
| 6,540,175 | B1 * | 4/2003 | Mayersak et al. | ..... | 244/3.15 |
| 6,668,727 | B1 * | 12/2003 | Kim et al. | ..... | 102/482 |
| 6,748,842 | B1 * | 6/2004 | Guirguis | ..... | 89/1.13 |
| 6,845,718 | B2 * | 1/2005 | Fortner et al. | ..... | 102/518 |
| 6,868,791 | B1 * | 3/2005 | Thompson et al. | ..... | 102/476 |
| 6,931,994 | B2 * | 8/2005 | Lloyd | ..... | 102/489 |
| 6,945,175 | B1 * | 9/2005 | Gotzmer et al. | ..... | 102/364 |
| 7,143,698 | B2 * | 12/2006 | Lloyd | ..... | 102/489 |
| 7,467,579 | B1 * | 12/2008 | Portmann | ..... | 89/1.13 |
| 7,484,447 | B1 * | 2/2009 | Portmann | ..... | 89/1.13 |
| 2004/0011238 | A1 * | 1/2004 | Ronn et al. | ..... | 102/492 |
| 2008/0156219 | A1 * | 7/2008 | Voss et al. | ..... | 102/402 |
| 2009/0211484 | A1 * | 8/2009 | Truitt et al. | ..... | 102/497 |

* cited by examiner

*Primary Examiner*—Benjamin P Lee
(74) *Attorney, Agent, or Firm*—Mark A. Wurm; Paul F. Rusyn; Graybeal Jackson LLP

(57) ABSTRACT

An anti-mine dart includes a body containing an explosive payload and having a flyer-plate port. The dart is operable responsive to the payload being detonated to propel through the flyer-plate port a flyer plate having sufficient energy to detonate an explosive material surrounding the dart. The darts may include a plurality of explosive payloads, flyer-plate ports and flyer plates. The darts may be formed in a stack arrangement within a missile such that the flyer-plate port of each dart is not aligned with the flyer-plate ports of any of the adjacent darts in the stack arrangement. The darts may contain a simplified safe-and-arm mechanism or no safe-and-arm mechanism at all.

19 Claims, 7 Drawing Sheets

COUNTERMINE DART SYSTEM AND METHOD

PRIORITY CLAIM

The present application is a Continuation-In-Part of U.S. patent application Ser. No. 12/150,106, filed Apr. 23, 2008, now abandoned; which application claims the benefit of U.S. Provisional Patent Application No. 60/926,050, filed Apr. 23, 2007; all of the foregoing applications are incorporated herein by reference in their entireties.

TECHNICAL FIELD

Embodiments of the present invention relate generally to countermine systems and, more specifically, to methods and systems that utilize airborne projectiles or "darts" for defeating anti-tank and anti-landing craft mines.

BACKGROUND

In many wartime or other hostile situations between countries or adversarial groups, anti-tank and anti-landing craft mines are deployed. These mines are typically buried on beaches and in the associated surf zones in an attempt to prevent or dissuade invasion of such a beach. These mines are encased explosive devices that are designed to detonate when disturbed, such as when a landing craft attempting to come ashore travels over one of the mines. Countermine systems have been developed to enable or assist invading forces to land on a beach where mines have been deployed. One such countermine system involves the airborne distribution of thousands of anti-mine projectiles or "darts" from a missile that is launched by an aircraft. These darts are deployed from the missile to spread across a desired area and free fall toward earth and toward the desired mine field. The darts penetrate through sand, soil, and water overburdens and upon contact with a mine are triggered, meaning the dart detonates an explosive payload.

FIG. 1 is a diagram illustrating the operation of conventional anti-mine darts 100 in detonating a deployed mine 102. The darts 100 are deployed from a missile as previously mentioned and fall towards a mine field formed by the deployed mines 102. Upon reaching the surface, the darts 100 penetrate soil, sand and/or water overburdens 104 and, once having passed through the overburdens, impact a top 106 of the mine 102. Upon impacting the top 106, the dart 100 is triggered and the timing of a payload engagement delay time Tped is initiated. The dart 100 continues to travel through TNT of the mine 102 and, upon expiration of the payload engagement delay time, the dart 100 detonates its high explosive payload. In response to the high explosive payload, the TNT and thus the mine 102 detonates, removing the threat of the mine. The payload engagement delay time Tped ensures that the dart 100 has traveled a sufficient distance into the TNT of the mine 102 such that upon detonation of the high explosive payload of the dart the TNT is detonated. If the dart 100 were to detonate upon impact of the top 106, the detonation of the high explosive payload of the dart may not detonate the TNT and thus may not cause detonation of the mine 102.

FIG. 2 is a cutaway view showing the interior of one of the conventional anti-mine darts 100 of FIG. 1 and illustrates the relatively large size of a high explosive payload 200 carried within a casing 202 of each dart. The high explosive payload 200 may be PBXN-5 or any other suitable extremely high explosive material, as will be appreciated by those skilled in the art. When PBXN-5 is used the payload is on the order of 5 grams of PBXN-5 in order to ensure proper operation of the dart. More specifically, the high explosive payload 200 must blow apart the casing 202 with sufficient energy to detonate the TNT contained in the mine 102 being detonated.

Due to the relatively large amount of the high explosive payload 200 contained within each dart 100, great care must be taken to prevent inadvertent detonation of the dart. For example, if one of the several thousand darts 100 contained within a missile detonates, the missile and possibly the plane deploying the missile could be destroyed. As a result, each dart 100 includes a safe-and-arm mechanism 300 as shown in the cross-sectional view of an individual dart in FIGS. 3A and 3B. The safe-and-arm mechanism 300 is positioned near the front of the dart 100 as illustrated in FIG. 3A while FIG. 3B is an enlarged view of the state and arm mechanism 300 showing the components in more detail. The safe-and-arm mechanism 300 includes a barrier 302 that must rotate 90° from the position shown as indicated by arrow 303 in order to establish a first condition to "arm" the dart 100 such that the high explosive payload 200 can be detonated. As each dart 100 falls after deployed from the missile, a pin 304 is forced outward as indicated by arrow 305 due to centrifugal force caused by the rotation of the dart as the dart falls to earth.

Upon initial impact with the overburdens 104 (FIG. 1), an assembly 306 of the safe-and-arm mechanism 300 shifts forward towards the front of the dart 100, as illustrated by arrow 308 in FIG. 3B to provide the second required condition for "arming" the dart. When the first and second conditions are satisfied, the barrier 302 rotates 90° from its position shown about an axis orthogonal to the cross-section of FIG. 3B. Once the barrier 302 rotates, the dart 100 is armed and ready to be detonated upon impact with a mine 102. When the front tip of the dart 100 impacts the top 106 of the mine 102, a trigger 310 ignites a primer 312 which, in turn, ignites a slow burn material 314 which provides the desired payload engagement delay time from impact of the dart with the top of the mine. The slow burn material 314 ignites an adjacent material 316 which thereafter, due to the barrier 302 having been rotated, results in ignition or detonation of the high explosive payload 200.

From this description of the operation of the safe-and-arm mechanism 300 contained within each dart 100 and the diagrams illustrated in FIGS. 2 and 3, it is seen that the safe and arm mechanism is a relatively complex structure, as is the overall structure of each dart. As a result, the manufacture of such darts 100 is relatively expensive and since thousands and possibly millions of such darts may be utilized in the types of military operations previously discussed, the manufacture and use of the darts 100 is very expensive. The safe-and-arm mechanism 300 must be utilized, however, to ensure inadvertent detonation of the high explosive payload 200 since such a detonation of one dart 100 could detonate all darts contained within a missile and such a missile could destroy the plane carrying that missile, and injure or kill the pilots and any passengers of the plane.

There is a need for an improved anti-mine dart that effectively and reliably detonates mines while having a reduced cost of manufacture and a reduced likelihood of inadvertent detonation.

SUMMARY

According to embodiments of the present invention, an anti-mine dart includes a body containing an explosive payload and having a flyer-plate port. The dart is operable responsive to the payload being detonated to propel through the flyer-plate port a flyer plate having sufficient energy to detonate an explosive material surrounding the dart. The darts may include a plurality of explosive payloads, flyer-plate ports and flyer plates. The darts may be formed in a stack arrangement within a missile such that the flyer-plate port of each dart is not aligned with the flyer-plate ports of any of the adjacent darts in the stack arrangement. The darts may contain a simplified safe-and-arm mechanism or no safe-and-arm mechanism at all.

DETAILED DESCRIPTION

Figure 1:
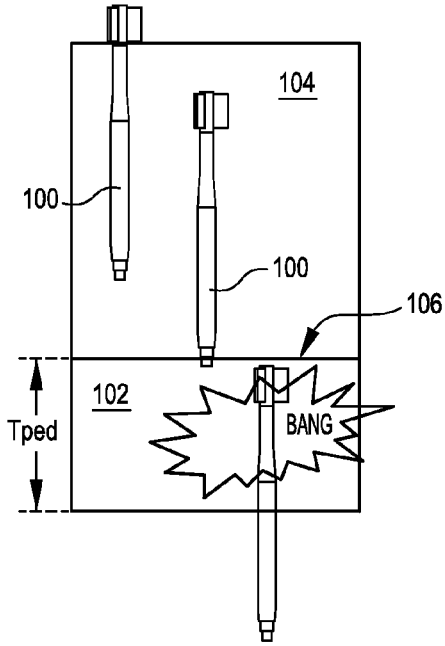
FIG. 1 (BACKGROUND ART)
FIG. 1 is a diagram illustrating the operation of conventional anti-mine darts in detonating a deployed mine.
Figure 2:
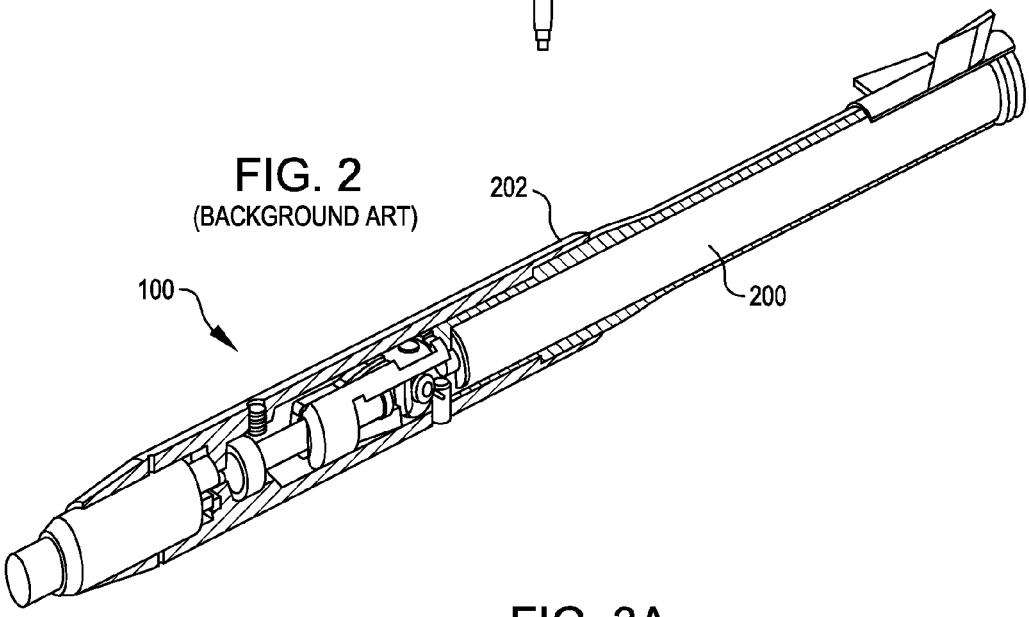
FIG. 2 (BACKGROUND ART)
FIG. 2 is a cutaway view showing the interior of one of the conventional anti-mine darts of FIG. 1 and illustrates the relatively large size of the high explosive payload carried by such a dart.
Figure 3A:
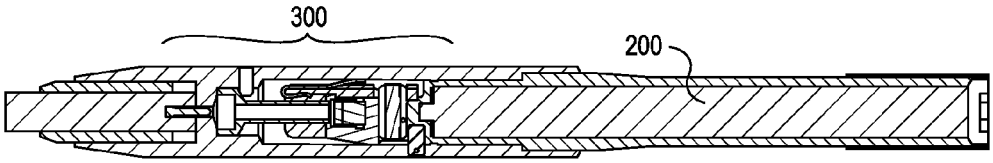
FIG. 3A (BACKGROUND ART)
FIGS. 3A and 3B are cross-sectional views of a safe-and-arm mechanism contained in the dart of FIG. 2 to prevent inadvertent detonation of the high explosive payload.
Figure 3B:
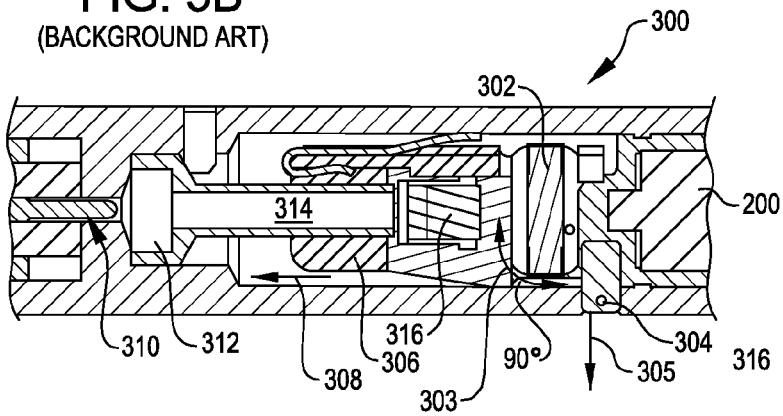
FIG. 3B (BACKGROUND ART)
Figure 4A:
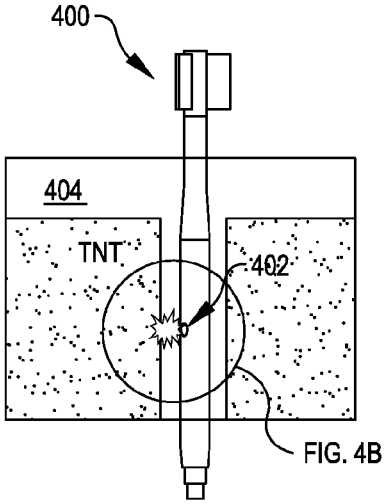
FIGS. 4A and 4B are diagrams illustrating an anti-mine dart carrying substantially less high explosive payload and accordingly requiring no safe-and-arm mechanism according to one embodiment of the present invention.
Figure 4B:
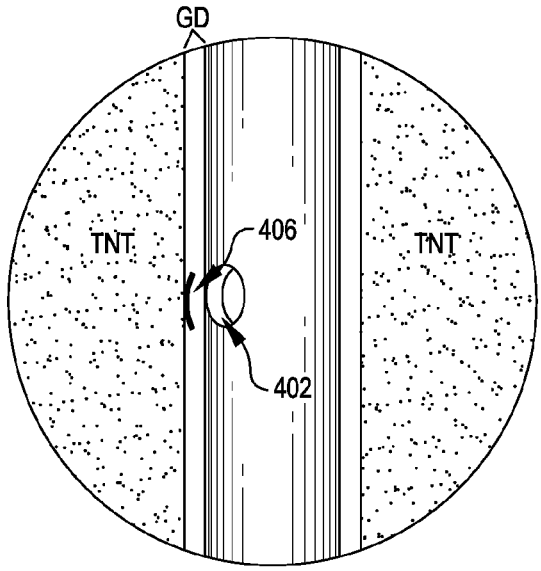

FIGS. 4A and 4B are diagrams illustrating an anti-mine dart 400 carrying substantially less high explosive payload and accordingly requiring no safe-and-arm mechanism according to one embodiment of the present invention. Eliminating the need for a safe-and-arm mechanism in each dart 400 greatly simplifies the complexity of manufacturing the dart and thereby significantly lowers the cost of each dart. As shown in FIGS. 4A and 4B, the anti-mine dart 400 includes a flyer-plate port 402 through which detonation of the high explosive payload (not shown in FIG. 4) is output to thereby detonate TNT contained in a mine 404. FIG. 4B is an exploded view of the portion of the dart 400 containing the flyer-plate port 402. As shown in FIG. 4B, detonation of the high explosive payload in the dart 400 ejects a flyer plate 406 through the port 402 with sufficient velocity to impart sufficient energy and pressure to the TNT in the mine 404 to thereby ignite the TNT and detonate the mine 404, as will be described in more detail below. The mine 404 is the same as the mine 102 previously discussed with reference to FIG. 1 and thus, for the sake of brevity, will not be described in more detail. Also note that although the mine 404 is shown as including TNT, the dart 400 may also be utilized to detonate mines 404 containing other explosive substances as well.

In the following description, certain details are set forth in conjunction with the described embodiments of the present invention to provide a sufficient understanding of the invention. One skilled in the art will appreciate, however, that the invention may be practiced without these particular details. Furthermore, one skilled in the art will appreciate that the example embodiments described below do not limit the scope of the present invention, and will also understand that various modifications, equivalents, and combinations of the disclosed embodiments and components of such embodiments are within the scope of the present invention. Embodiments including fewer than all the components of any of the respective described embodiments may also be within the scope of the present invention although not expressly described in detail below. Finally, the operation of well known components and/or processes has not been shown or described in detail below to avoid unnecessarily obscuring the present invention.

Figure 5:
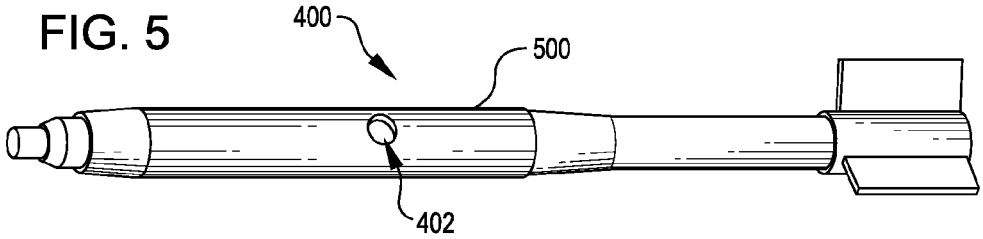
FIG. 5 is a diagram better illustrating a flyer-plate port contained in a body of the anti-mine dart of FIG. 4.
Figure 6A:
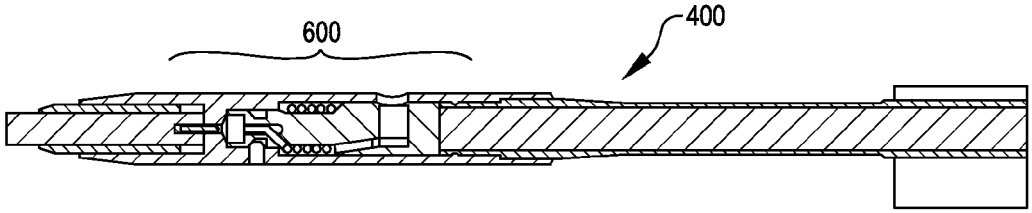
FIGS. 6A and 6B are cross-sectional views of the dart of FIGS. 4 in 5 according to one embodiment of the present invention.
Figure 6B:
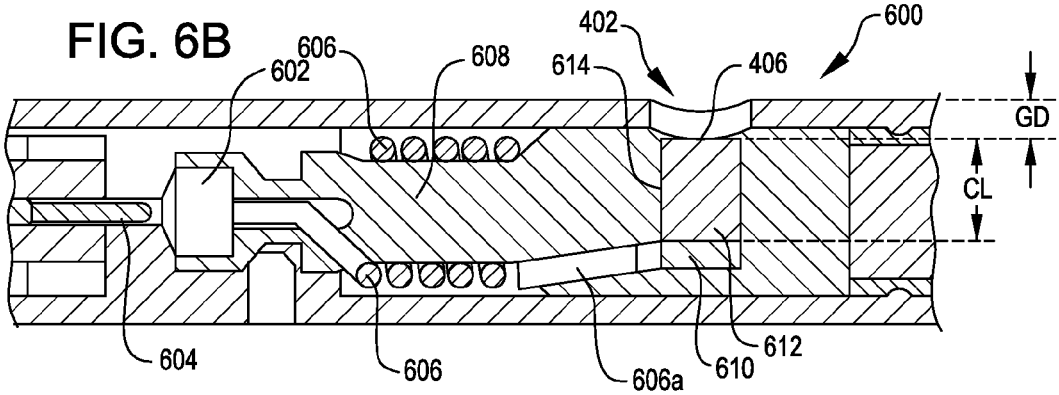

The flyer plate 406 is a small piece of metal, aluminum, steel, or suitable material that is propelled out of the dart 400 through the flyer-plate port 402 and across a gap distance GD to impact the TNT of the mine 404. The gap distance GD will be discussed in more detail below with reference to FIG. 6B. FIG. 5 is a diagram better illustrating the flyer-plate port 402 contained in a body 500 of the anti-mine dart 400 of FIG. 4. FIGS. 6A and 6B are cross-sectional views of the dart 400 of FIGS. 4 in 5 according to one embodiment of the present invention. FIG. 6A is a cross section of the entire dart 400 including a detonation mechanism 600 positioned near the front tip of the dart. FIG. 6B is an enlarged view of the detonation mechanism 600 which is shown to include a primer material 602 positioned adjacent a firing pin 604 which ignites the primer upon impact of the dart 400 with the top of the mine 404 (FIG. 4).

Ignition of the primer material 602 ignites a micro second delay column 606 that is wound around a delay mandrel 608 of the detonation mechanism 600. A final portion of the micro second delay column 606, which is designated 606*a* in FIG. 6B, when ignited, in turn, ignites a primary explosive material 610 positioned adjacent the portion 606*a*. The primary explosive material 610 is positioned adjoining a high explosive payload 612, with the primary explosive material 610 and high explosive payload 612 being contained within a cup-shaped enclosure 614. A top portion of the cup-shaped enclosure 614, when separated from the cup-shaped enclosure, forms the flyer-plate 406 previously discussed with reference to FIG. 4B.

In operation, upon impact of the dart 400 with the mine 404 the firing pin 604 ignites the primer material 602 which, in turn, ignites the micro second delay column 606. The micro second delay column 606 provides the desired payload engagement delay time Tped previously discussed with reference to FIG. 1. The delay column 606 is wound around the delay mandrel 608 to thereby increase a length of the delay column and provide the required delay time Tped. The final portion 606*a* of the delay column 606 ignites the primary explosive material 610 which, in turn, ignites the high explosive payload or material 612, blowing apart the cup-shaped enclosure 614 and propelling the flyer plate 406 out the flyer-plate port 402. A first distance designated a gap distance GD and a second distance designated a column length CL are illustrated in FIG. 6B. The parameters GD and CL have values to ensure that the flyer plate 406 has sufficient energy to detonate the TNT in the mine 404 (not shown in FIG. 6) the dart 400 has penetrated, and will be discussed in more detail below with reference to FIGS. 11 and 12.

In another embodiment of the dart 400 illustrated in FIG. 6B, the final portion 606*a* of the delay column 606 is repositioned such that a longitudinal axis of this portion extending along a length of this portion is parallel to a longitudinal axis extending along a length of the cup-shaped enclosure 614 and orthogonal to the top portion or flyer-plate 406. In this way, a blast direction of the final portion 606*a* of the delay column 606 is in the same direction as a blast direction of the primary explosive material 610 and high explosive material 612, as will be appreciated by those skilled in the art. In FIG. 6B such a longitudinal axis extending along a length of the cup-shaped enclosure 614 and orthogonal to the top portion or flyer-plate 406 would extend vertically in this cross-sectional view. Therefore, the final portion 606*a* would be repositioned in this embodiment to have a longitudinal axis that also extends vertically.

Figure 7A:
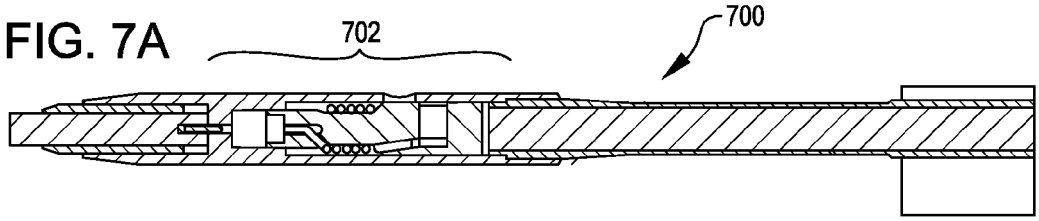
FIGS. 7A-7C are cross-sectional views of an anti-mine dart according to another embodiment of the present invention in which the dart includes a safe-and-arm mechanism.
Figure 7B:
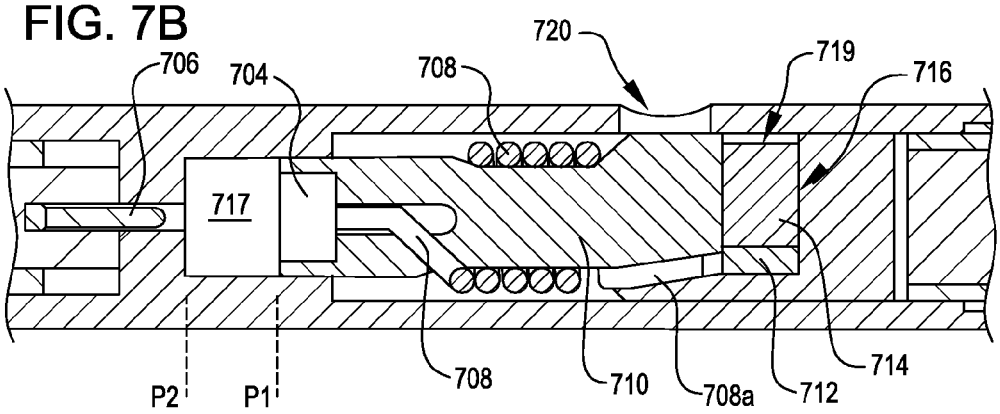
Figure 7C:
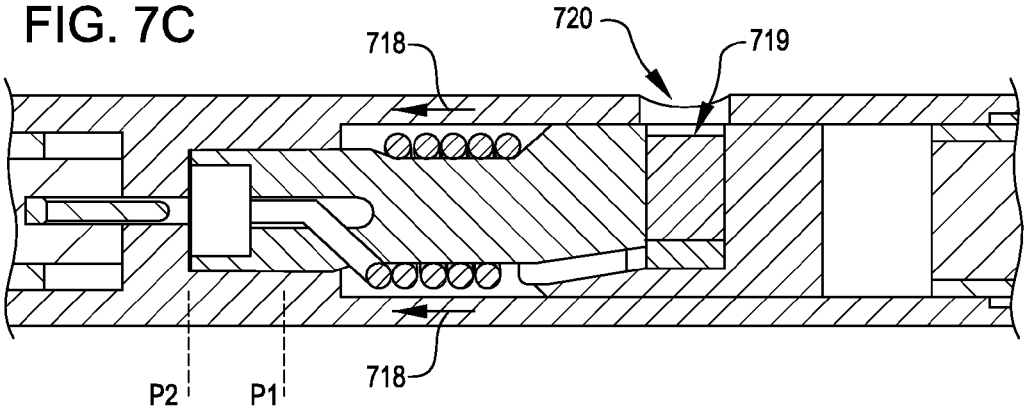

FIGS. 7A-7C are cross-sectional views of a dart 700 according to another embodiment of the present invention in which the dart includes a simplified safe-and-arm mechanism 702. The safe-and-arm mechanism 702 includes the detonation mechanism 600 previously described with reference to FIGS. 6A and 6B and the components 704-716 correspond to the components 602-614 described with reference to FIGS. 6A and 6B and thus, for the sake of brevity, these components will not again be described in detail. Note that in this embodiment the primer material 704 is spaced apart from the firing pin 706 by a length of a tube 717. In the "safe" position shown in FIG. 7B, notice that in addition to the primer material 704 being spaced apart from the firing pin 706, the explosive payload 714 and a flyer-plate 719 are not aligned with a flyer-plate port 720.

In the embodiment of FIG. 7, upon impact of the dart 700 with the top of the mine 404 (FIG. 4) the entire detonation mechanism shifts forward towards the front of the dart via the tube 717, as illustrated by the arrows 718 and FIG. 7C. This puts the dart 700 in the "armed" condition. In FIG. 7B, a front portion of the primer material 704 is at a position P1, which is spaced apart from the firing pin 706 and the mechanism 702 by the length of the tube 717. Conversely, in FIG. 7C the mechanism 702 is in the armed position and the front portion of the primer material 704 is shifted to a position P2 adjacent the firing pin 706, as represented by arrows 718 in FIG. 7C. Also note that in FIG. 7C the explosive payload 714 and flyer plate 719 have also moved forward towards the front of the dart 700 and are now aligned with the flyer-plate port 720. Upon impact of the dart 700 with the top of the mine 404, the operation of the components 704-716 is the same as previously described with reference to FIGS. 6A and 6B to propel a flyer-plate 719 through the flyer-plate port 720.

Figure 8A:
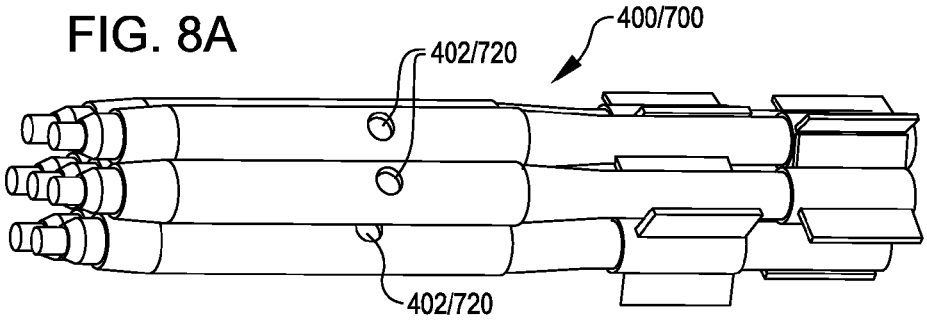
FIGS. 8A-8C illustrate the packing of a number of the darts of FIGS. 4 and 5 or 7 within a missile prior to deployment.
Figure 8B:
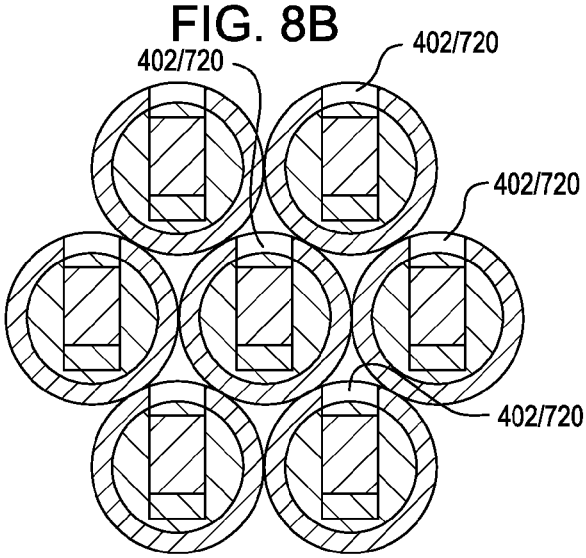
Figure 8C:
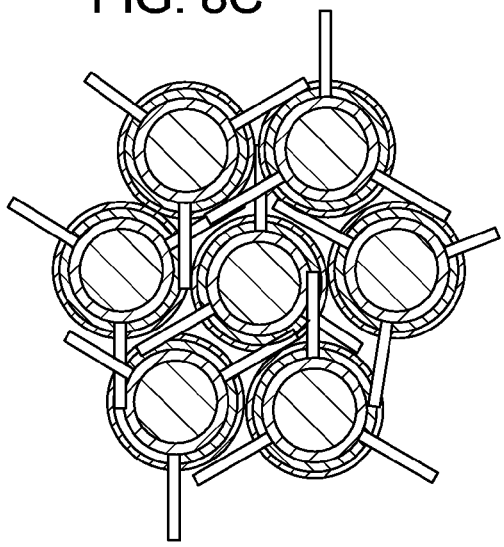

FIGS. 8A-8C illustrate the packing of a number of the darts 400 or 700 of FIGS. 4 and 5 or 7 within a missile (not shown) prior to deployment. FIG. 8A shows that when stacked the arrangement of the flyer-plate ports 402, 720 is such that none of the ports is aligned with in another port so that inadvertent detonation of any one of the darts 400 will not detonate another one of the adjacent darts. This is true because of the relatively small amount of high explosive material 612 (714) contained within the darts 400 and 700 according to embodiments of the present invention. In the following description only the darts 400 will be discussed although the comment supply with equal force to the darts 700. With embodiments of the present invention, the detonation of any single dart 400 does not result in unwanted detonation of adjacent darts and the resulting unwanted explosion of the missile or plane containing the darts. In one embodiment, the high explosive material 612 is approximately 0.1 grams of PBXN-5, which is 50 times smaller than the 5 grams contained in the conventional dart 100 of FIG. 1. This much less high explosive material 612 of course makes the darts 400 much safer in the event of inadvertent detonation. FIG. 8B is a cross-sectional view of the stacked darts 400 showing how the flyer-plate ports 402 of adjacent darts 400 are not aligned. FIG. 8C shows the stacking of the darts from a tail end of the darts and shows fins contained on such tail ends. By ensuring the flyer-plate ports 402 of adjacent darts 400 are not aligned, the inadvertent detonation of one dart results in the flyer plate 406 of that dart impacting the body 500 (FIG. 5) an adjacent dart and not the flyer-plate port of that adjacent dart. The flyer plate 406 does not have sufficient energy to pierce and detonate the adjacent dart due to the relatively small amount of high explosive material 612 contained within the dart 400.

Figure 9:
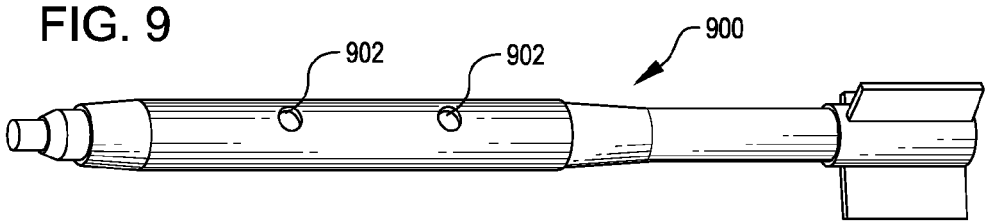
FIG. 9 is a diagram illustrating a dart containing multiple flyer-plate ports according to another embodiment of the present invention.
Figure 10A:
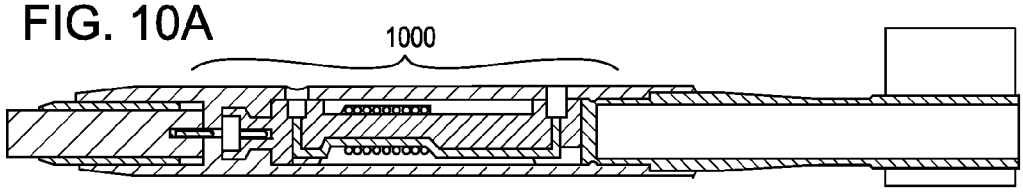
FIGS. 10A-10C are cross-sectional views illustrating the dart of FIG. 9 according to one embodiment of the present invention.
Figure 10B:
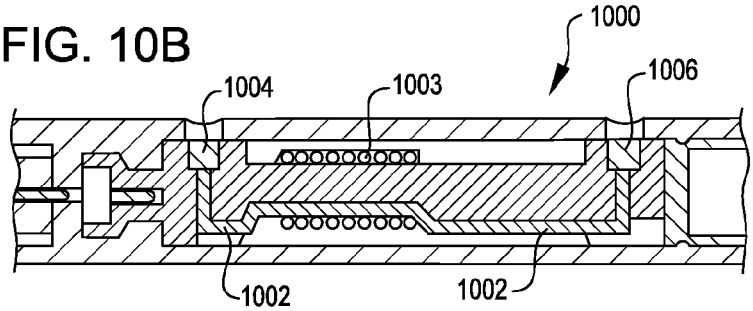
Figure 10C:
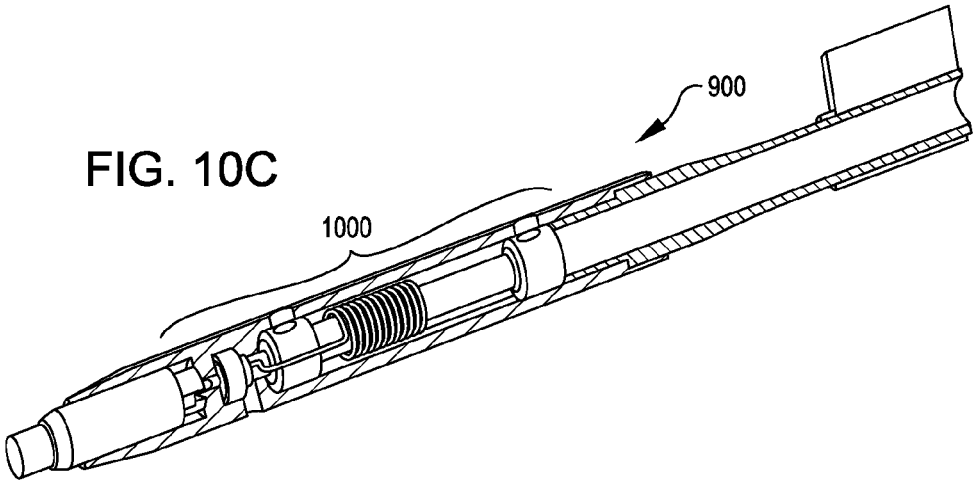

FIG. 9 is a diagram illustrating a dart 900 containing multiple flyer-plate ports 902 according to another embodiment of the present invention. FIGS. 10A-10C are cross-sectional views illustrating a detonation mechanism 1000 of the dart 900 of FIG. 9 according to one embodiment of the present invention. FIG. 10A is an isometric cut away view of the dart 900 while FIG. 10B is a side cross-sectional view, with FIG. 10C being a exploded view showing the detonation mechanism 100 of the dart in more detail. The detonation mechanism 1000 is substantially similar to those previously described except that a detonating cord 1002 is ignited by a micro second delay line 1003, with the detonating cord igniting dual high explosive payloads 1004 and 1006. Briefly, the micro second delay line 1003 functions in the same way as previously described but instead of being connected directly to the high explosive payloads 1004, 1006, the delay line is connected through the detonating cord 1002 to the payloads. In operation, the micro second delay line 1003, once ignited, burns and after the delay time Tped ignites the detonating cord 1002. Once ignited, the detonating cord 1002 burns to thereby ignite the high explosive payloads 1004, 1006, causing a flyer plate to be propelled through each flyer-plate port 902 to detonate the TNT of a mine (not shown) which the dart 900 has penetrated.

Figure 11:
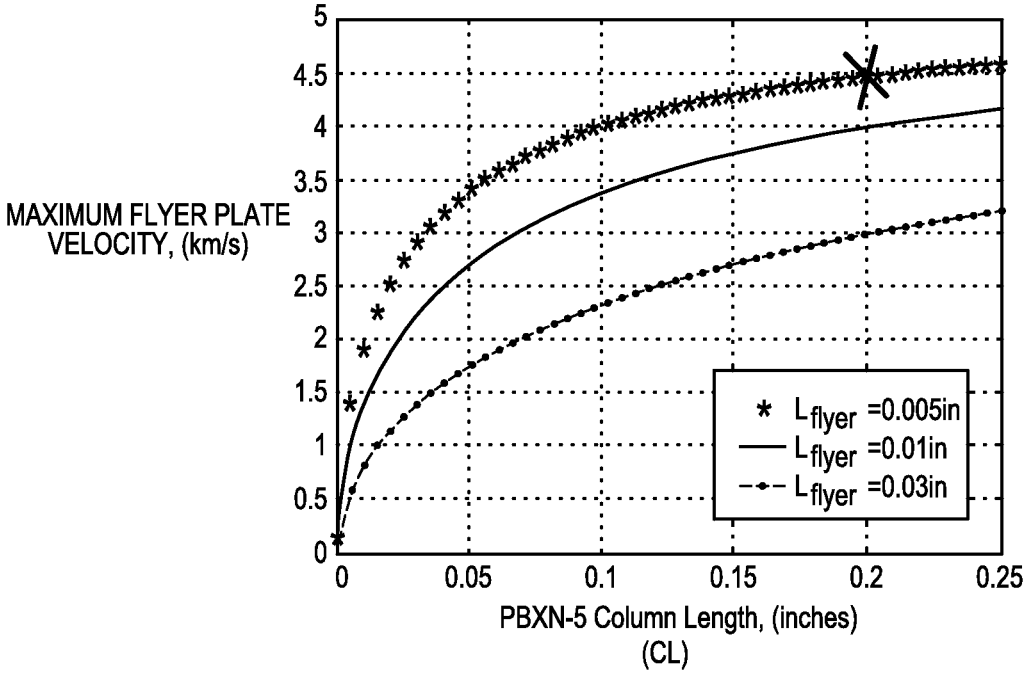
FIG. 11 is a graph illustrating maximum flyer-plate velocity as a function of column length as illustrated in FIG. 6B.
Figure 12:
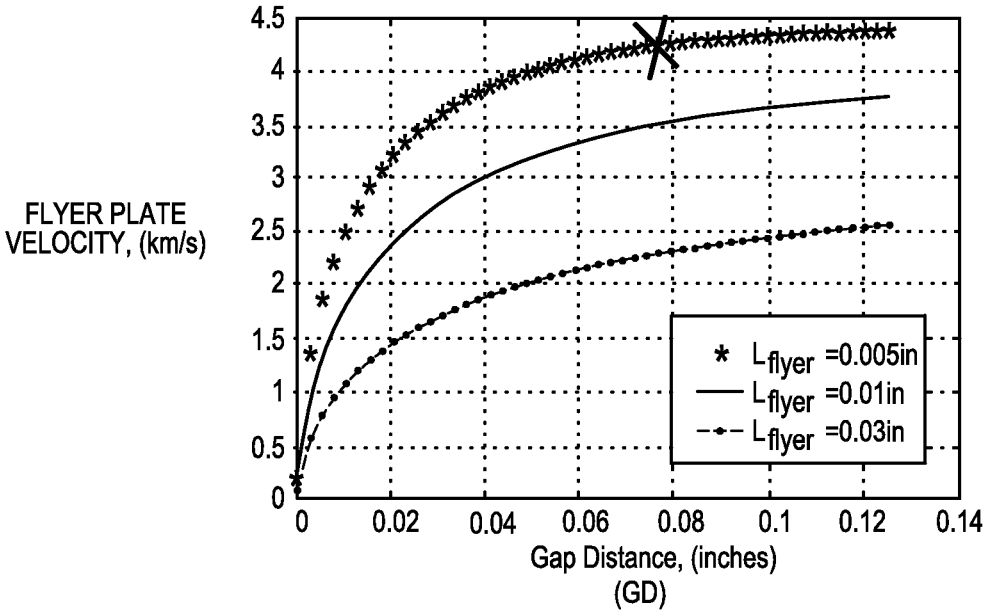
FIG. 12 is a graph illustrating flyer-plate velocity as a function of gap distance as illustrated in FIG. 6B.

FIG. 11 is a graph illustrating maximum flyer-plate velocity as a function of column length CL, as illustrated in FIG. 6B. FIG. 11 illustrates that for a column length of approximately 0.2 inches, a flyer-plate velocity of 4.5 km/s is achieved. FIG. 12 illustrates that for a gap distance GD (FIG. 6B) of approximately 0.075 inches a flyer-plate velocity of approximately 4.25 km/s is achieved. These velocities for a stainless steel flyer plate 0.005 inches thick result in the production of sufficient energy (>100 cal/cm2) and overpressure condition (>18.9 GPa) to initiate detonation of TNT and thereby detonation of the mines 404. The specific parameters associated with the graphs of FIGS. 11 and 12 are 304 Stainless Flyer Plate 0.005 in thick, PBXN-5 Column Length 0.195 inches, Gap Distance 0.075 inches, Critical Energy=152 cal/cm2 and Contact Pressure=50 GPa. As FIGS. 11 and 12 demonstrate, the term "flyer plate" corresponds to any kinetic mass having sufficient energy and overpressure condition to initiate detonation of TNT or other explosive, such as those kinetic masses sometimes referred to as slapper plates and those referred to as shape or shaped charges, as will be appreciated by those skilled in the art.

Figure 13:
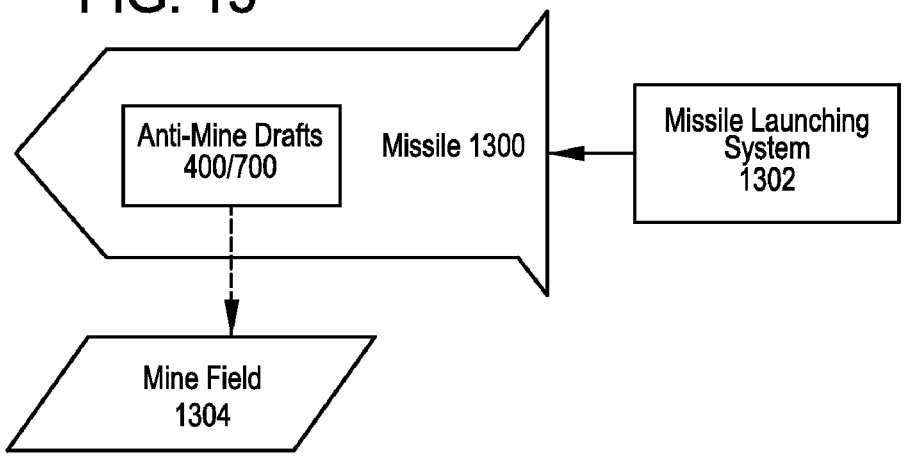
FIG. 13 is a diagram illustrating a missile launch system and a missile containing a plurality of anti-mine darts of FIGS. 4 and/or 7 according to an embodiment of the present invention.

FIG. 13 is a diagram of a missile 1300 containing a plurality of anti-mine darts 400/700 according to one embodiment of the present invention. The missile is fired from an airplane or other suitable missile launching system 1302 and thereafter ejects the anti-mine darts 400/700 when in a proper position to cause the missiles to fall upon a desired mine field 1304, such as on a beach as previously discussed. The anti-mine darts 400/700 upon deployment from the missile 1300 fall upon the mine field 1304 and some of the darts impact mines in that mine field and operate as previously described to detonate those mines. The darts 400/700 will be deployed to impact the mine field 1304 with a desired concentration so that a sufficient number of darts impact each square foot of the mine field to detonate mines contained therein. The number of darts 400/700 and number missiles required will depend upon a variety of different factors, such as the size of the mine field, the number of darts 400/700 carried by each missile, and so on, as will be appreciated by those skilled in the art.

Even though various embodiments and advantages of the present invention have been set forth in the foregoing description, the above disclosure is illustrative only, and changes may be made in detail and yet remain within the broad principles of the present invention. Moreover, the functions performed by the individual components contained in the darts 400, 700 can be combined to be performed by fewer elements, separated and performed by more elements, or combined into different functional blocks, as will be appreciated by those skilled in the art. Therefore, the present invention is to be limited only by the appended claims.

What is claimed is:

1. An anti-mine dart, comprising:

a body containing an explosive payload and having a flyer-plate port, the dart being operable responsive to the explosive payload being detonated to propel through the flyer-plate port a flyer plate having sufficient energy to detonate an explosive material surrounding the dart, wherein the anti-mine dart further comprises a safe-and-arm mechanism operable in a safe mode to position the flyer plate in a first position where the flyer plate is not positioned adjacent the flyer-plate port, and operable in an armed mode upon impact of the dart to position the flyer plate in a second position where the flyer plate is positioned adjacent the flyer-plate port.

2. The anti-mine dart of claim 1, wherein the flyer plate has sufficient energy to detonate TNT.

3. The anti-mine dart of claim 1, wherein the flyer plate is stainless steel.

4. The anti-mine dart of claim 1, wherein the explosive payload is approximately 0.1 grams of PBXN-5.

5. The anti-mine dart of claim 1, further comprising a plurality of flyer-plate ports and a plurality of explosive payloads, each explosive payload being positioned to propel, when ignited, a flyer plate through a corresponding one of the flyer-plate ports.

6. The anti-mine dart of claim 1, further comprising:

a delay column operable to detonate the explosive payload a payload engagement delay time after being activated; and a delay trigger mechanism operable to activate the delay column upon impact of the anti-mine dart with a mine.

7. The anti-mine dart of claim 6, wherein the payload engagement delay time is on the order of microseconds.

8. The anti-mine dart of claim 6, further comprising a delay mandrel around which the delay column is wound to thereby provide a delay column having a length to provide the desired payload engagement delay time.

9. An anti-mine dart, comprising:

a housing having a tip end and a tail end and including a flyer-plate port, the housing containing, a detonation mechanism positioned near the tip end of the housing, the detonation mechanism operable responsive to the dart impacting a mine to generate an ignition signal;

a delay column wound around a delay mandrel, the delay column having a first end and a second end, the first end being positioned adjacent the detonation mechanism and the first end being ignited responsive to the ignition signal, the delay column operable to ignite the second end a delay time after the first end is ignited;

a primary explosive material positioned adjacent the second end of the delay column and being ignited upon ignition of the second end of the delay column after the delay time;

a cup-shaped enclosure having a top portion which when separated from the other portions of the enclosure forms a flyer plate, the top portion being aligned with the flyer-plate port during an armed mode of operation of the dart, and the cup-shaped container having an open end opposite the top portion and the cup-shaped enclosure containing a high explosive payload, the high explosive material being positioned adjacent the primary explosive material via the open end and being ignited responsive to the primary explosive material being ignited, and responsive to the ignition of the high explosive material the top portion of the enclosure separating from the other portions of the enclosure to form the flyer plate and the flyer plate being propelled through the flyer-plate port; and wherein the housing is cylindrical and tapered towards the tail end, and wherein the housing further includes fins formed adjacent the tail end.

10. An anti-mine dart, comprising:

a housing having a tip end and a tail end and including a flyer-plate port, the housing containing, a detonation mechanism positioned near the tip end of the housing, the detonation mechanism operable responsive to the dart impacting a mine to generate an ignition signal;

a delay column wound around a delay mandrel, the delay column having a first end and a second end, the first end being positioned adjacent the detonation mechanism and the first end being ignited responsive to the ignition signal, the delay column operable to ignite the second end a delay time after the first end is ignited;

a primary explosive material positioned adjacent the second end of the delay column and being ignited upon ignition of the second end of the delay column after the delay time;

a cup-shaped enclosure having a top portion which when separated from the other portions of the enclosure forms a flyer plate, the top portion being aligned with the flyer-plate port during an armed mode of operation of the dart, and the cup-shaped container having an open end opposite the top portion and the cup-shaped enclosure containing a high explosive payload, the high explosive material being positioned adjacent the primary explosive material via the open end and being ignited responsive to the primary explosive material being ignited, and responsive to the ignition of the high explosive material the top portion of the enclosure separating from the other portions of the enclosure to form the flyer plate and the flyer plate being propelled through the flyer-plate port;

wherein the housing includes fins formed adjacent the tail end of the housing; and wherein the fins are formed relative to the flyer-plate ports so that when a plurality of darts are arranged in a stack arrangement, the flyer-plate port of each dart in the stack is not aligned with the flyer-plate ports of any of the adjacent darts in the stack arrangement.

11. The anti-mine dart of claim 10, wherein the detonation mechanism comprises a firing pin extending from the tip end of the housing and a primer material positioned adjacent the firing pin, the firing pin operable to move responsive to the dart impacting a mine relative to the primer and to ignite the primer material through the movement.

12. The anti-mine dart of claim 11, wherein the dart further includes a safe-and-arm mechanism, comprising:

a tube positioned toward the front end of the housing, wherein during a safe mode of operation the primer material is positioned near a first end of the tube opposite a second end of the tube near where the firing pin is positioned to separate the firing pin from the primer material, and the top portion of the cup-shaped enclosure is positioned spaced apart from the flyer-plate port; and during the armed mode of operation, the primer material moving through the tube to approximately the first end and the top portion of the cup-shaped enclosure moving into alignment with the flyer-plate port.

13. The anti-mine dart of claim 10, wherein the housing further includes at least one additional flyer-plate port;

wherein an additional primary explosive material and cup-shaped enclosure are positioned adjacent each additional flyer-plate port; and wherein a detonating cord is positioned between the second end of the delay column and each primary explosive material, the detonating cord being ignited by the delay column and thereafter igniting each of the primary explosive materials.

14. The anti-mine dart of claim 10, wherein the top portion of the cup-shaped enclosure is always positioned aligned with the flyer-plate port.

15. The anti-mine dart of claim 10, wherein the flyer-plate corresponds to a slapper plate.

16. The anti-mine dart of claim 10, wherein the flyer plate corresponds to a shape or shaped charge.

17. A missile comprising a plurality of anti-mine darts, each dart having a body containing an explosive payload and having a flyer-plate port, each dart operable responsive to the payload being detonated to propel a flyer plate having sufficient energy to detonate an explosive material surrounding the dart, and the darts being formed in a stack arrangement within the missile, with the flyer-plate port of each dart in the stack arrangement being such that the flyer-plate port of each dart is not aligned with the flyer-plate ports of any of the adjacent darts in the stack arrangement.

18. The missile of claim 17, wherein each dart further comprises a plurality of flyer-plate ports and a plurality of explosive payloads, each explosive payload being positioned to propel, when ignited, a flyer plate through a corresponding one of the flyer-plate ports.

19. The missile of claim 17, wherein each anti-mine dart further comprises a delay column operable to detonate the explosive payload a payload engagement delay time after being activated.

* * * * *